US007708165B2

(12) United States Patent
Bistolfi

(10) Patent No.: US 7,708,165 B2
(45) Date of Patent: May 4, 2010

(54) VENT MEANS AND VENT FLANGE FOR A DEVICE DISPENSING AT LEAST ONE LIQUID AND METHOD FOR APPLYING A MEMBRANE TO A VENT FLANGE

(75) Inventor: Maurizio Bistolfi, S. Giuliano Vecchio (IT)

(73) Assignee: Guala Dispensing S.p.A., Spinetta Marengo (Alessandria) (IT)

( * ) Notice: Subject to any disclaimer, the term of this patent is extended or adjusted under 35 U.S.C. 154(b) by 905 days.

(21) Appl. No.: 11/446,502

(22) Filed: Jun. 5, 2006

(65) Prior Publication Data

US 2007/0131718 A1 Jun. 14, 2007

(30) Foreign Application Priority Data

Aug. 8, 2005 (EP) ..... 05425584

(51) Int. Cl.
*B67D 7/76* (2010.01)

(52) U.S. Cl. ..... 222/189.09; 222/189.11; 222/207; 222/383.1; 239/323

(58) Field of Classification Search ..... 222/189.09, 222/189.11, 383.1, 207; 239/323
See application file for complete search history.

(56) References Cited

U.S. PATENT DOCUMENTS

| | | | | |
|---|---|---|---|---|
| 4,694,976 | A * | 9/1987 | Schuetz | 222/189.11 |
| 5,472,119 | A * | 12/1995 | Park et al. | 222/145.8 |
| 6,257,455 | B1 * | 7/2001 | Trepina et al. | 222/189.09 |

FOREIGN PATENT DOCUMENTS

| | | |
|---|---|---|
| DE | 2944344 | 5/1980 |
| EP | 1442995 | 8/2004 |
| FR | 1486569 | 6/1967 |
| WO | WO 94/11115 | 5/1994 |

* cited by examiner

*Primary Examiner*—Kevin P Shaver
*Assistant Examiner*—Andrew P Bainbridge
(74) *Attorney, Agent, or Firm*—Shoemaker and Mattare

(57) ABSTRACT

A vent for a liquid dispenser includes a vent flange comprising a flange body. The vent body includes a vent wall on which the membrane is applied. The vent wall extends parallel to the geometric axis of the device so as to have a sufficiently large area available for applying the transpiratory membrane and at the same time to limit the space occupied radially by the flange.

11 Claims, 8 Drawing Sheets

VENT MEANS AND VENT FLANGE FOR A DEVICE DISPENSING AT LEAST ONE LIQUID AND METHOD FOR APPLYING A MEMBRANE TO A VENT FLANGE

FIELD OF THE INVENTION

This invention refers to a vent for a device dispensing at least one liquid. The vent is suitable for venting towards the outside environment of gaseous fluids generated by the liquid contained in a container of the dispensing device.

This invention also refers to a vent flange for the dispensing device.

This invention also refers to a method for applying a membrane to the flange body of the vent flange.

BACKGROUND OF THE INVENTION

It is known that a dispensing device, for example of the trigger type, comprising a container for a liquid to be dispensed and a dispenser head, requires a vent system which enables the internal ventilation of the container.

In fact, some liquids release vapors so that in the absence of a vent system they tend to build up inside the container, even provoking bulging of the same.

Some known types of dispensing devices contain a mechanical vent active only in specific functioning phases of the device, such as during the dispensing phase.

A dispensing device produced as described above is shown, for example, in document WO97/38796. Another device produced as described above is shown in document EP-A1-1199105, in the name of the same Applicant.

The need has therefore arisen to produce dispensing devices equipped with means of ventilation that are always active, that is able to perform their ventilation function whatever the functioning configuration of the device.

Examples of such dispensing devices are shown in documents EP-A1-0729901 and EP-A1-0891228.

However, such solutions cannot be used in dispensing devices of the type comprising a container and a dispensing head.

SUMMARY OF THE INVENTION

The purpose of this invention is to provide a vent, a vent flange and a method for applying a membrane to the vent flange which overcomes the drawbacks shown by the known solutions and which, at the same time, satisfies the above requirements.

BRIEF DESCRIPTION OF THE DRAWINGS

The features and advantages of the invention can be seen from the description below, given by way of example and not limited to such, as per the following drawings.

DETAILED DESCRIPTION OF THE INVENTION

Figure 1:
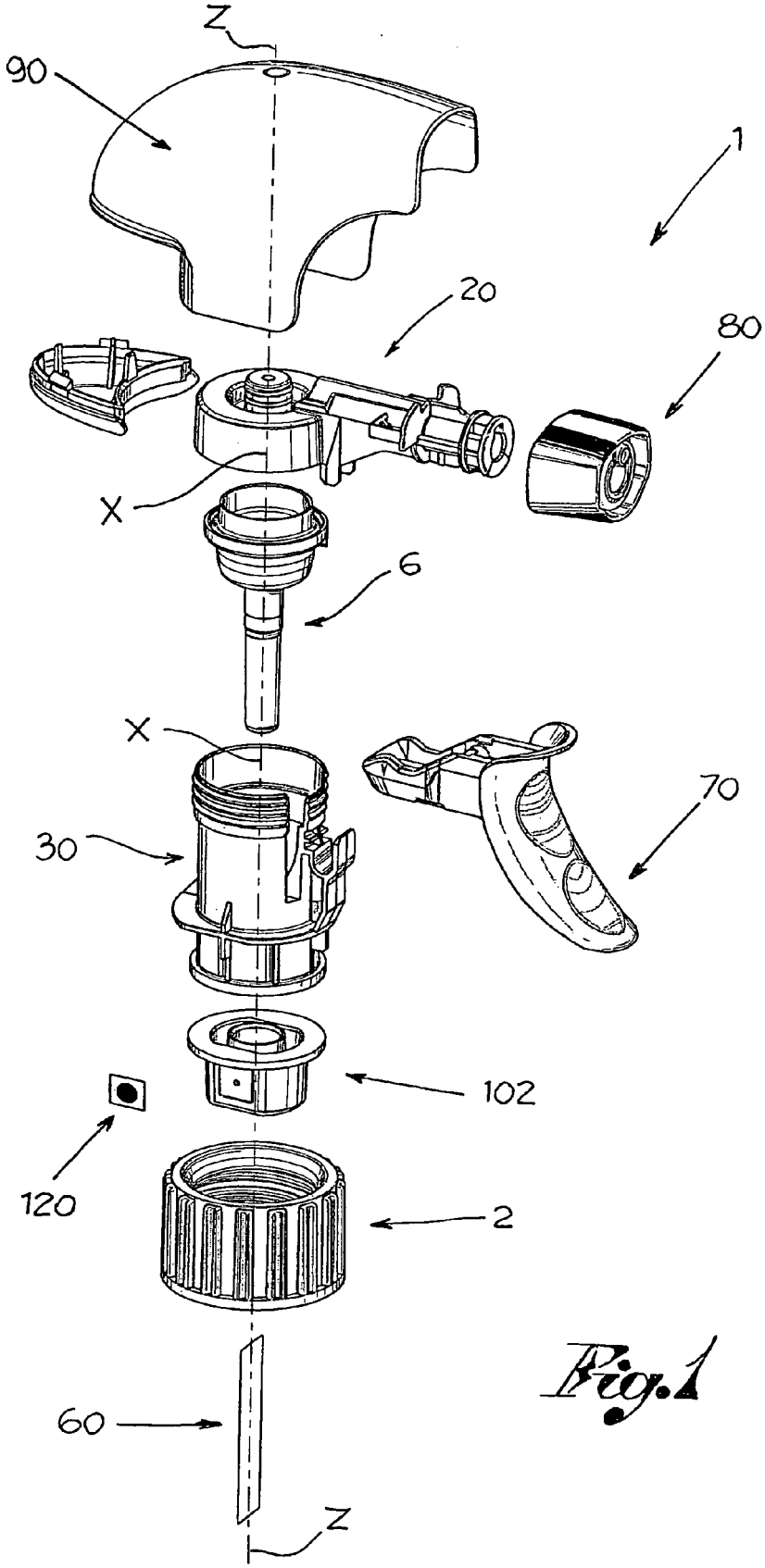
FIG. 1 is a perspective drawing in separate parts of a dispensing device including a vent flange as per this invention.
Figure 2:
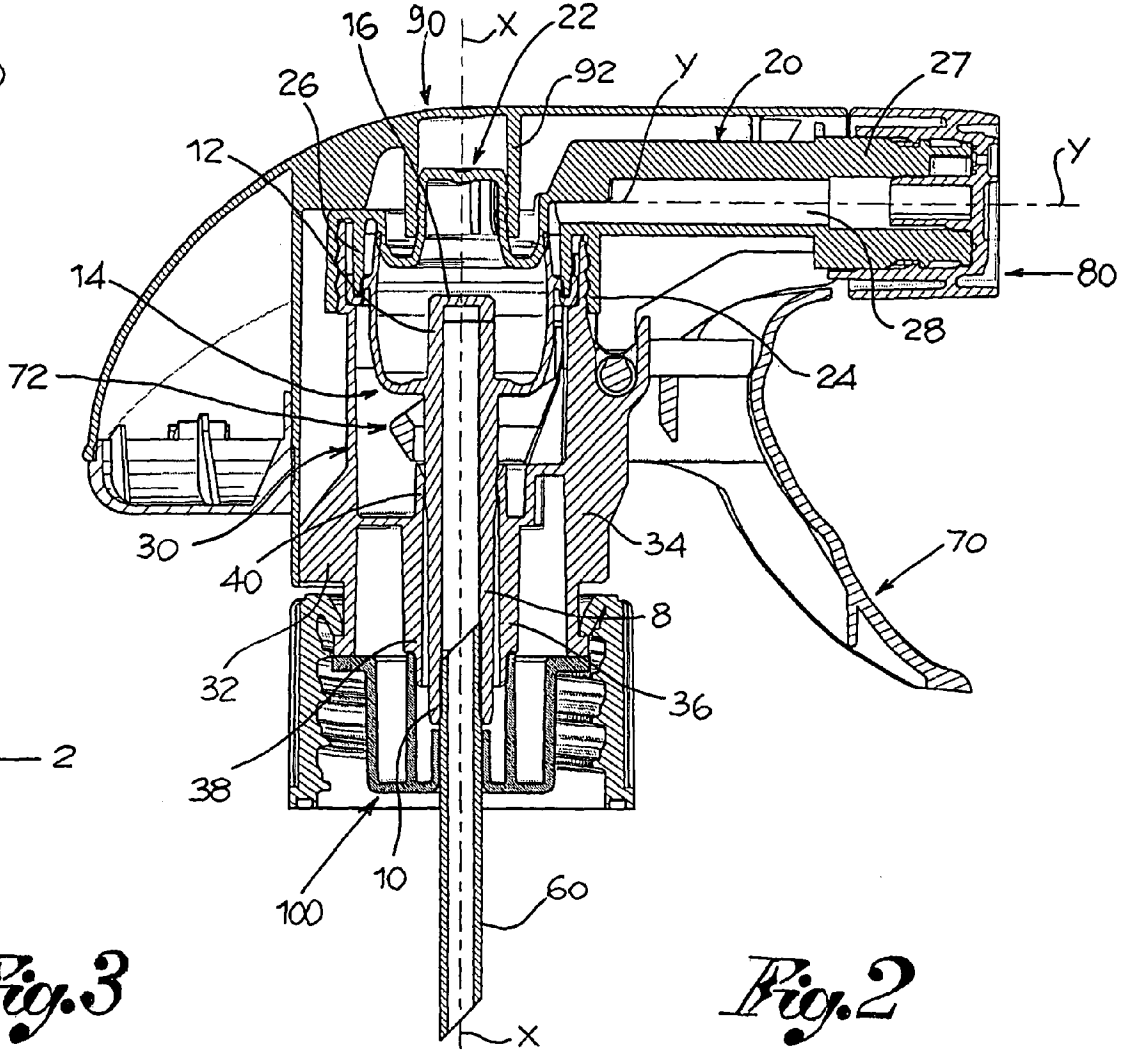
FIGS. 2 and 3 show partial cross-sections of the dispensing device in FIG. 1.
Figure 3:
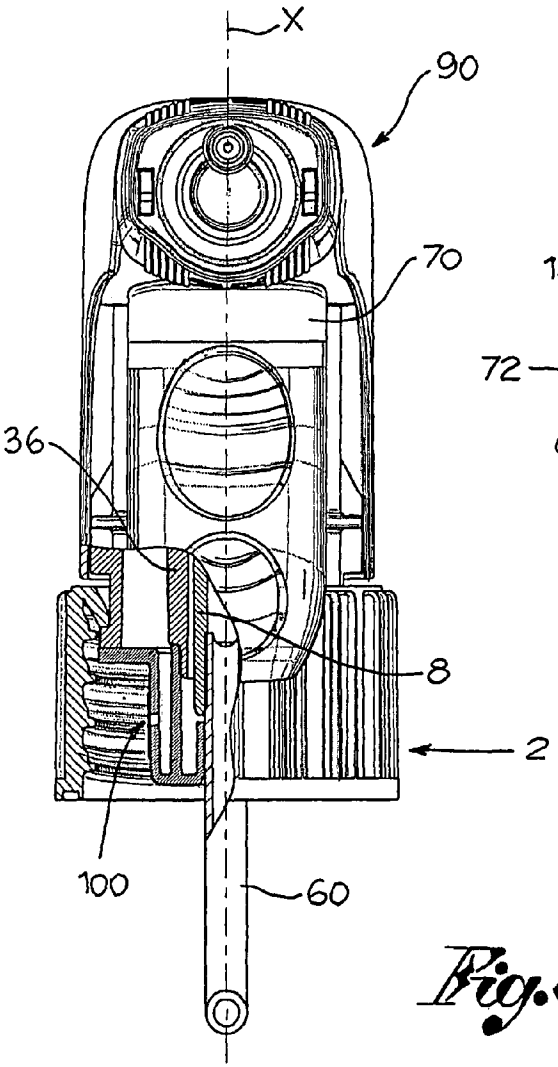
Figure 4:
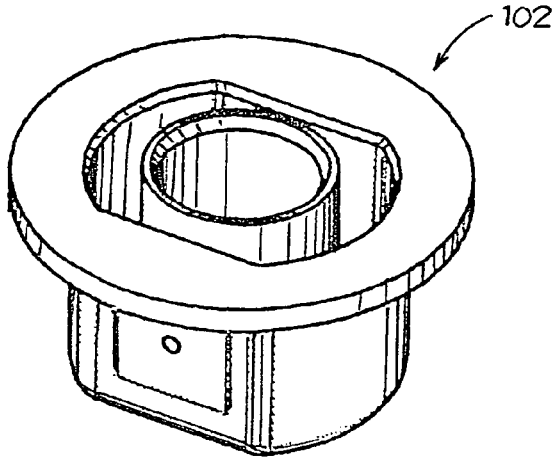
FIG. 4 is a perspective view of the vent flange in FIG. 1.
Figure 5:
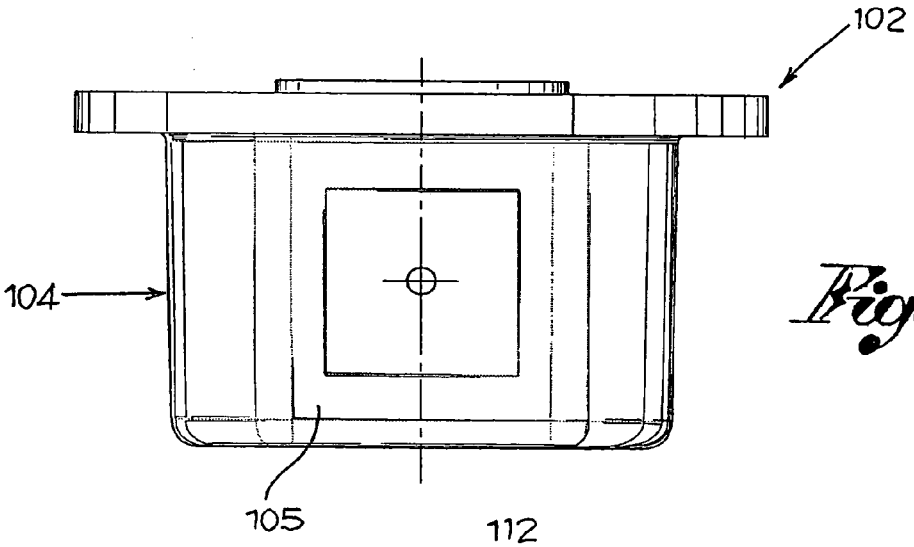
FIGS. 5 and 6 are plan views of the vent flange in FIG. 4.
Figure 6:
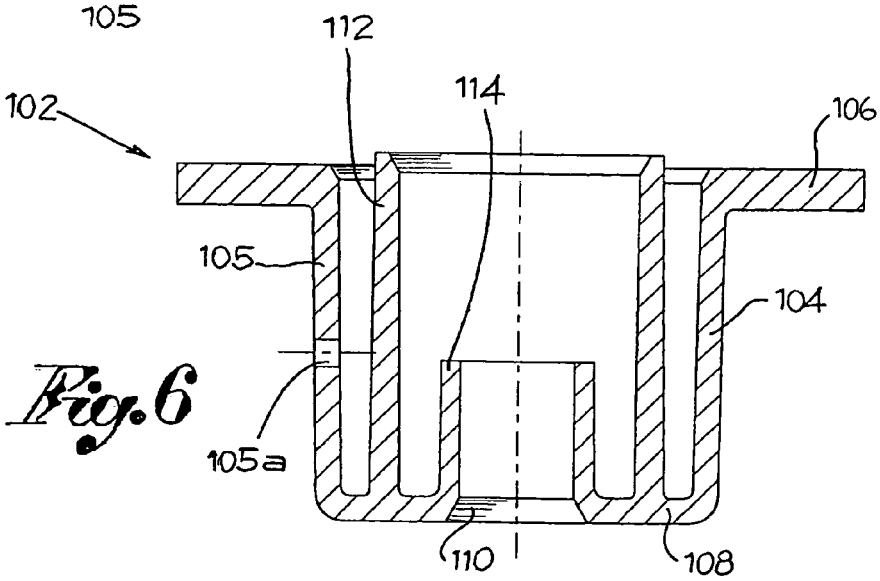

A dispensing device suitable for dispensing a liquid comprises means of containment suitable for containing the liquid (FIGS. 1 to 6).

For example, the means of containment include a container defining a volume for containing the fluid. The container has an aperture, delimited by an annular rim.

The annular rim extends in an annular manner around a geometric axis Z-Z. Perpendicular to the geometric axis Z-Z a geometric plane can be seen, denominated the picture plane.

Additionally, the device includes a dispenser head 1, which may be associated with the means of containment, for example by means of a threaded ring nut 2.

The dispenser head 1 includes a pumping mechanism which is suitable for being activated to suck a pre-set quantity of liquid from the means of containment during a suction step and suitable for dispensing the pre-set quantity of fluid to the outside of the dispenser during the dispensing step.

Preferably, the pumping mechanism includes a piston element 6 including a tubular rod 8 which extends along a pumping axis X-X from the lower end 10 near the bottom of the container, and an upper end 12, opposite to the lower end 10.

In addition, the piston element 6 includes a flexible cup-shaped membrane 14 which is connected to the tubular rod 8 near the upper end 12.

At the height of the upper end 12, the tubular rod 8 presents a closed wall 16 which occludes the upper end 12 of the tubular rod 8, partially separated from the remaining part of the tubular rod 8 by means of an incision.

Additionally, the pumping mechanism preferably includes a coupling element 20 including a delimiting wall 22 suitable for coupling to the flexible membrane 14.

The coupling element 20 includes an attachment wall 24 and a backstop wall 26, radially spaced out from each other and extending mainly along the pumping axis X-X.

Further, the coupling element 20 includes a tubular dispensing element 27 which delimits a dispensing conduit 28 extending mainly along a dispensing axis Y-Y, preferably perpendicular to the pumping axis X-X.

Further, the dispenser head includes a support body 30 extending mainly along the pumping axis X-X.

Preferably, the support body 30 includes an external abutting wall 32, an external hinging wall 34 and an internal tubular guiding wall 36.

The internal tubular guiding wall 36 extends from the lower end 38 close to the container, to the upper end 40 opposite the lower end.

Further, the dispenser head 1 may be connected to an elongated tubular element 60 extending mainly along the pumping axis X-X, connecting with the tubular rod 8, for example inserted close to the lower end 10 of the tubular rod 8 to suck the liquid from close to the bottom of the container.

Further the dispenser head 1 includes an operating mechanism suitable for being activated by a user so as to activate the pumping mechanism.

Preferably, the operating mechanism includes a trigger 70 suitable for being hinged to the support body 30. Further the operating mechanism include an active portion 72, connected to the trigger 70, suitable for influencing the pumping mechanism for the dispensing of the fluid.

Further, the dispenser head 1 includes a means of opening/closing suitable for being operated so as to enable/disable dispensing of the fluid.

In a preferred version, the means of opening/closing includes a closing element 80 suitable for inserting, at least partially, in the dispensing conduit of the coupling element and for changing from a closed position in which it prevents the dispensing of fluid to an open position, rotated compared to the closed position, in which the dispensing is enabled.

Furthermore, the dispenser head 1 includes a covering system suitable for covering, at least partially, the pumping mechanism.

In one version, the covering system includes a covering wall 90 suitable for being coupled to the support body 30 and the delimiting wall 22.

The covering wall 90 includes an annular offshoot 92 which juts out from the wall and which is suitable for accommodating, at least partially, and retaining the delimiting wall 22 of the coupling element 20.

Further the dispenser device includes a vent of the "passive" type, in other words able to function independently of the functioning position of the dispenser device.

The vent includes a vent flange 100 including a flange body 102 including an annular wall 104, which can be inserted in the opening of the container.

The annular wall 104 includes a vent wall 105 which at least one conduit 105*a* passes through.

Preferably the vent wall 105 has a flat outside surface.

The flange body 102 includes, in addition, a ledge wall 106 connected to the annular wall 104 which is suitable for abutting onto the edge of the opening of the container.

Preferably the ledge wall 106 is in the form of an annular crown jutting out radially and externally from the annular wall 104, preferably perpendicular to it.

The flange body 102 includes moreover a base wall 108 positioned at the extremity of the annular wall 104.

The base wall 108 has a through hole 110.

The body of the flange includes, in addition, a dividing wall 112 concentric to the annular wall 102 positioned inside it and jutting out from the base wall 108 inside the flange body 102.

Preferably, the dividing wall 112 is tapered moving away from the base wall 108.

The flange body 102 includes moreover, a delimiting wall 114 concentric to the annular wall 102 arranged around the through hole 110 jutting out from the base wall 108 inside the flange body 102.

The vent includes moreover, filtering means connected with the vent conduit 105*a* of the vent wall 105 suitable for enabling the passage through the vent conduit 105*a* of gaseous fluids such as the vapors generated by the liquid contained in the container. At the same time the filtering means are suitable for preventing the passage of the liquid through the vent conduit 105*a* towards the outside.

The filtering means occupy a coupling area of the vent wall 105 which, projecting parallel to the geometric axis on the plane of projection, defines a projection with a smaller superficial extension than the coupling area.

In other words the filtering means are positioned on a vent wall not perpendicular to the geometric axis, so as to be able to provide an extensive coupling area without increasing the radial dimension of the space occupied by the vent flange.

To explain in yet another way, by positioning the vent wall, which the filtering means are fitted on, obliquely compared to the geometric axis, an extensive vent wall is produced while limiting the radial extension of the vent flange, in other words perpendicular to the geometric axis.

In a particularly preferred version, the vent wall is parallel to the geometric axis, that is the coupling area and the geometric axis are not incident.

Preferably, the vent includes a transpiratory membrane 120 which, preferably, has a multi-layered structure.

The transpiratory membrane contains a transpiratory layer, made from Gore-Tex® for example, and a connecting layer which is suitable for being secured to the vent wall 105 to attach the membrane to the vent wall.

Generally, in assembling the dispensing device, the tubular rod 8 is inserted into the internal tubular guiding wall 36 of the support body 30.

Further, the trigger 70 is hinged to the hinging wall 34 of the support body 30 and the active portion 72 of the trigger 70 lies below the flexible membrane 14.

The flexible membrane 14 is kept in position between the support body 30 and the coupling element 20. Specifically the delimiting wall 22 is positioned axially distanced from the membrane 14 delimiting with it a dispensing chamber for the dispenser head.

The covering wall 90 is positioned so as to cover the coupling element 20, keeping the delimiting wall 22 of the coupling element 20 in position by means of the annular offshoot 92.

The annular wall 104 of the vent flange 100 is inserted through the opening of the container and the ledge wall 106 abuts onto the annular rim of the opening.

The dispenser head is located above the vent flange 100. Specifically, the support body 30 abuts on the ledge wall 106 so that the ledge wall 106 is pinched between annular rim of the container and the support body 30.

As can be seen, the vent wall 105 of the flange 100 is bent by the means of connection towards the annular rim of the container, so as to be attached to the dispensing device avoiding the leakage of liquid towards the outside of the container.

In other words, the vent wall 105, by means of the ledge wall 106, is compressed between the annular rim of the container and the ring nut 2 so as to avoid the leakage of fluid between the vent flange and the rim of the container itself, despite the vent wall being arranged so as to separate, at least partially, the internal compartment from the environment outside the space.

The tubular element 60, connected to the tubular rod 8 of the piston body, goes through the vent flange 100, and is inserted into the through hole 110 in the base wall 108.

The delimiting wall 114 which surrounds the through hole 110 surrounds the tubular element 60 and the flange to prevent the liquid in the container from leaking towards the outside.

In other words, the cavity between the delimiting wall 114 and the tubular element 60 produces a compensation conduit with a crown-shaped cross sectional area.

The structural and functional details relating to such a system for preventing the leakage of a liquid are described in the European patent application No. 05425271.3 in the name of the same Applicant. Such application is incorporated here by reference for the realization of the system.

Further, the dividing wall 112 which couples onto the lower end 38 of the internal tubular guiding wall 36 of the support body 30 creates a further seal which, beneficially, blocks the leakage of liquid towards the cavity formed by the dividing wall 112 and the annular wall 104, preventing the transpiratory membrane 120 from being bathed by the liquid which, through the vent conduit 105*a* reaches the connecting layer of the transpiratory membrane.

The cavity between the dividing wall 112 and the annular wall 104 and the cavity between the internal tubular guiding wall 36 and the external abutting wall 32 of the support body 30 form a section of a vent conduit which is suitable for connecting the conduit 105*a* of the vent flange 100 with the outside environment, for example through apertures made in the support body 30.

Figure 7:
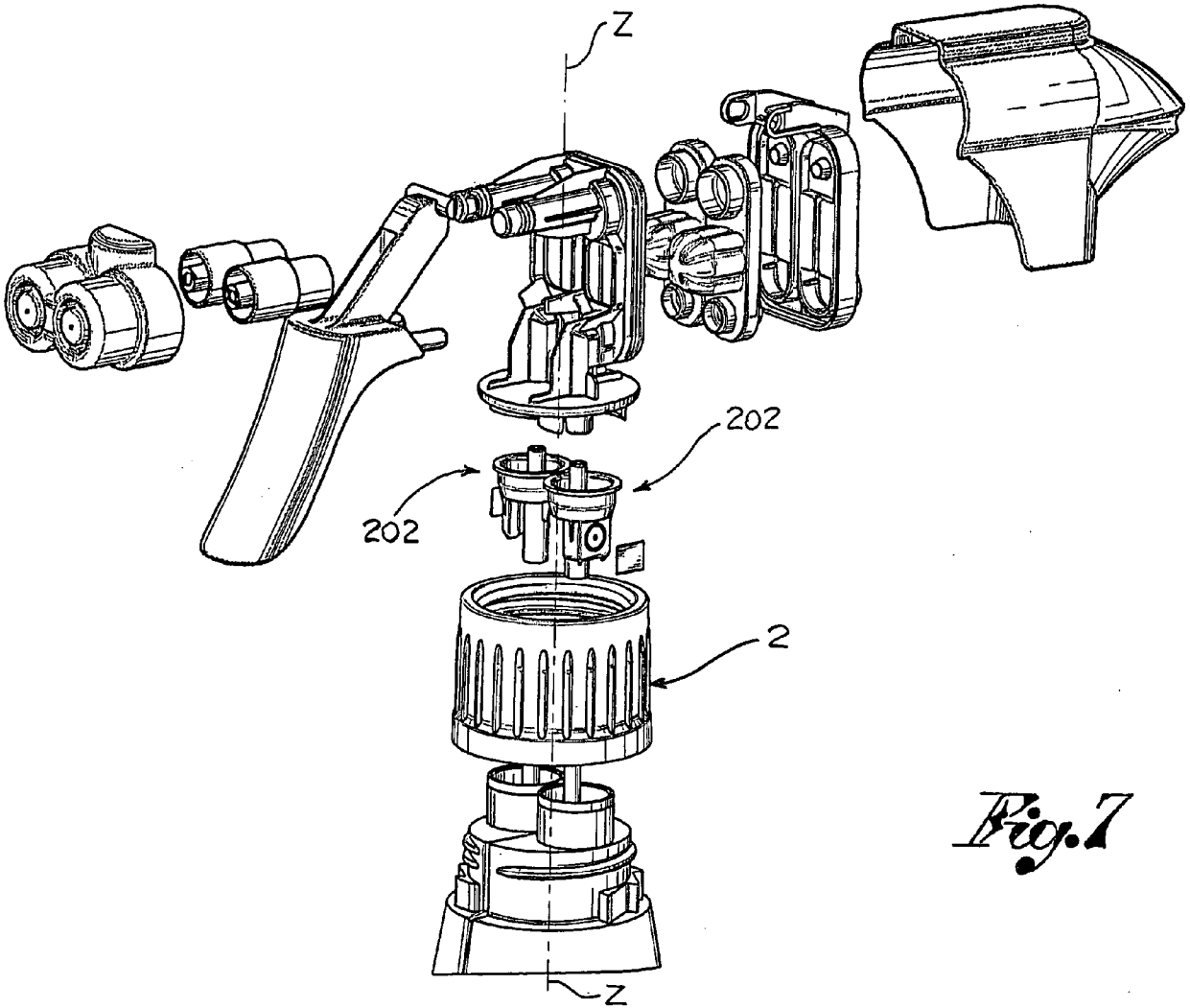
FIG. 7 is a perspective drawing in separate parts of a dispensing device containing a vent flange as in this invention as in a further variation.
Figure 8:
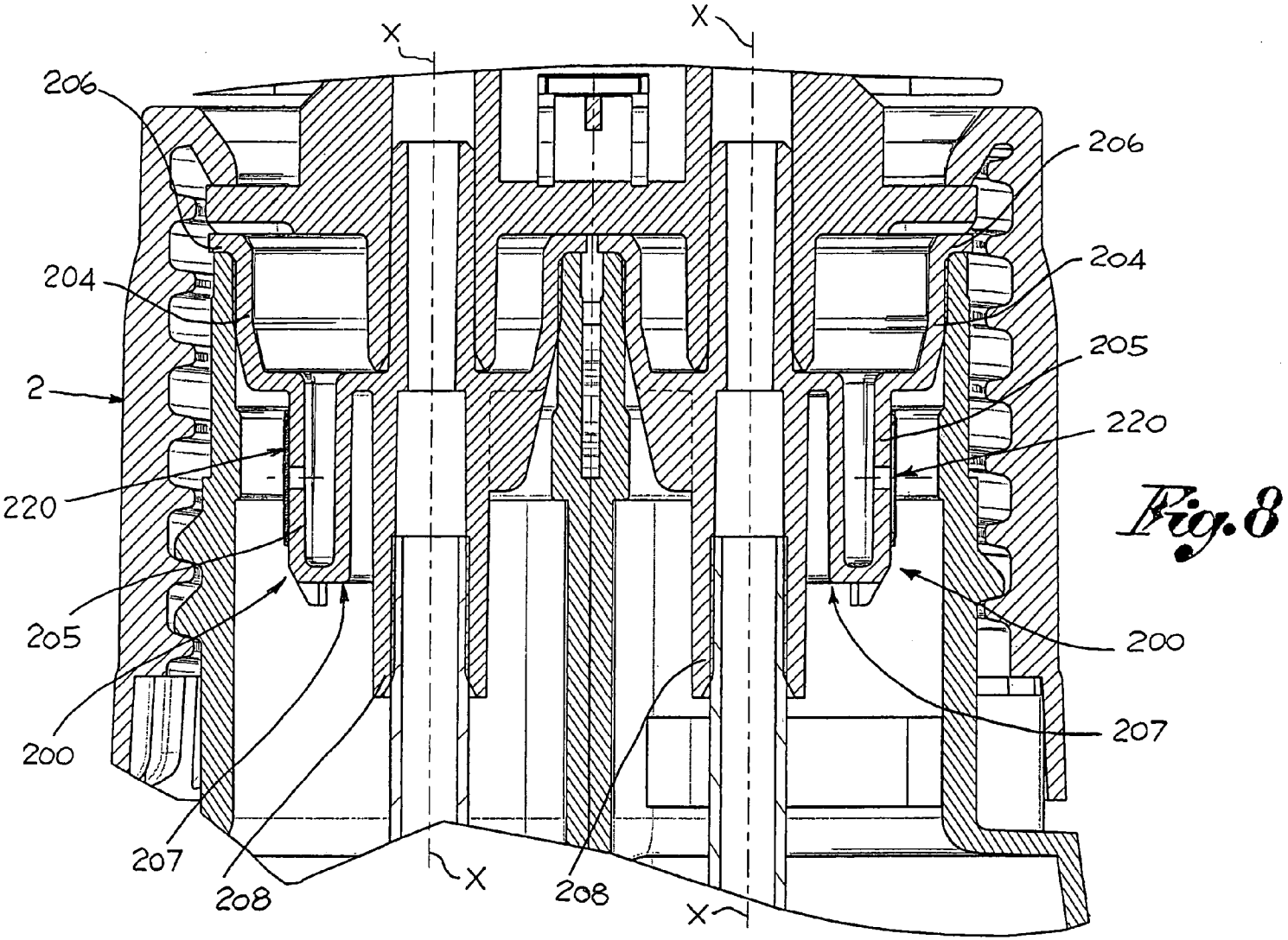
FIG. 8 shows a cross-section of a detail of the device in FIG. 7.

In another version, a dispensing device as described in this invention is suitable for dispensing two liquids at the same time (FIGS. 7 and 8).

The dispensing device includes a dispenser head. The structural and functional details of the dispenser head are described in the document EP-A1-1527822 in the name of the same Applicant. Such document is incorporated herein inasmuch as relevant to the realization of the dispenser head.

Similarly to what has been described for the dispenser device suitable for dispensing only one liquid, the dispenser device suitable for dispensing two liquids has a means of containment which is suitable for containing the two liquids separately, such as a container with two separate compartments. The container has two openings, delimited by their respective annular rims.

Furthermore, the dispenser head can be connected to the means of containment by means of a threaded ring nut 2.

Further the dispenser device includes a vent of the "passive" type, in other words able to function independently of the functioning position of the dispenser device.

The vent include two vent flanges 200, generally identical in structure. Below, the relative description is given with reference to only one of these.

The vent flange 200 includes a flange body 202 including an annular wall 204 which can be inserted in the opening of the container.

The flange body 202 also includes a vent wall 205 which at least one conduit 205*a* goes through, protruding with respect to the annular wall 204.

Specifically, the vent wall 205 forms a sack 207, with a polygonal cross-section for example or with a trapezoidal cross-section for example, protruding from the annular wall 204.

Preferably, the vent wall 205 has a flat outer surface.

The flange body 202 includes, in addition, a ledge wall 206 connected to the annular wall 204 which is suitable for abutting onto the rim of the opening of the container.

The flange body 102 includes, moreover, a through conduit 208 around which is the annular wall.

The sack 207 flanks the through conduit 208 thus producing an asymmetric configuration for the flange 200.

Figure 9:
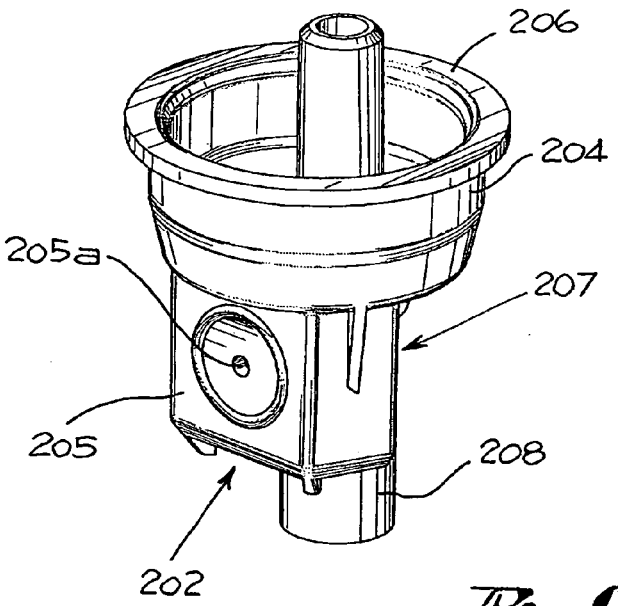
FIG. 9 is a perspective drawing of the flange in FIG. 7.
Figure 10:
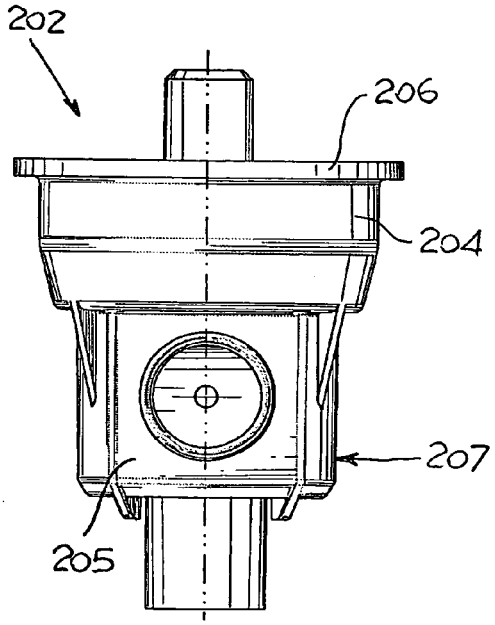
FIGS. 10 and 11 are plan views of the flange in FIG. 9.
Figure 11:
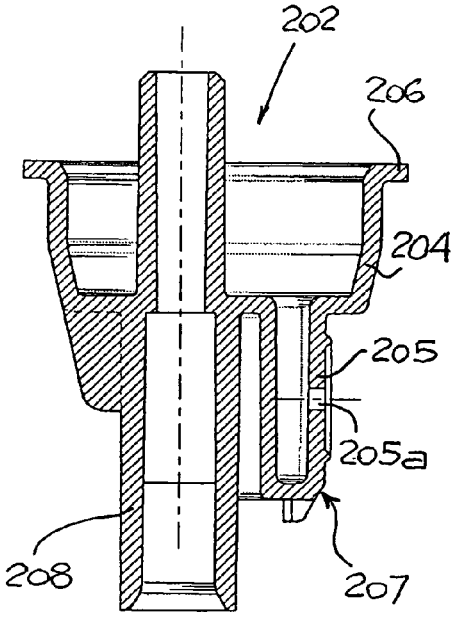

Preferably, the sack 207 is detached from the through conduit 208, producing a cavity 209 between the through conduit 208 and the sack 207 (FIGS. 9, 10 and 11).

Figure 12:
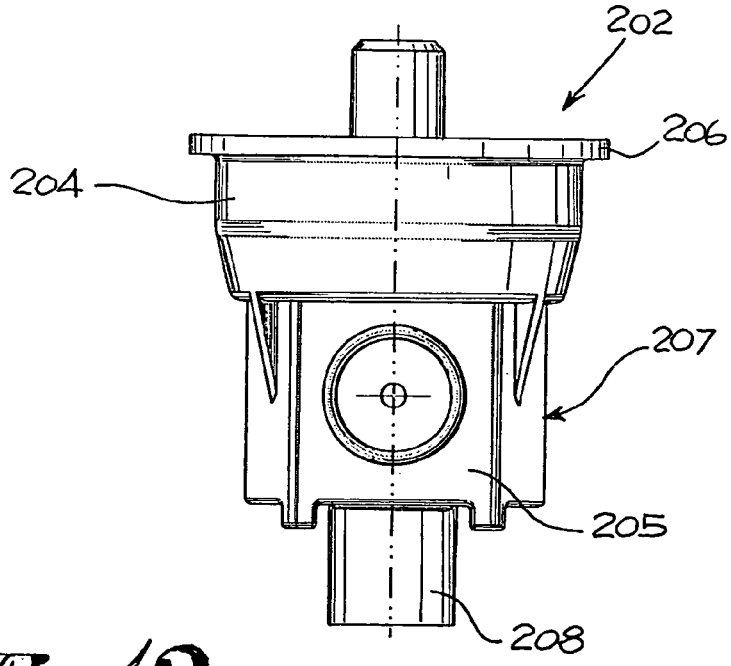
FIGS. 12 and 13 are plan views of a vent flange produced as in a further variation.
Figure 13:
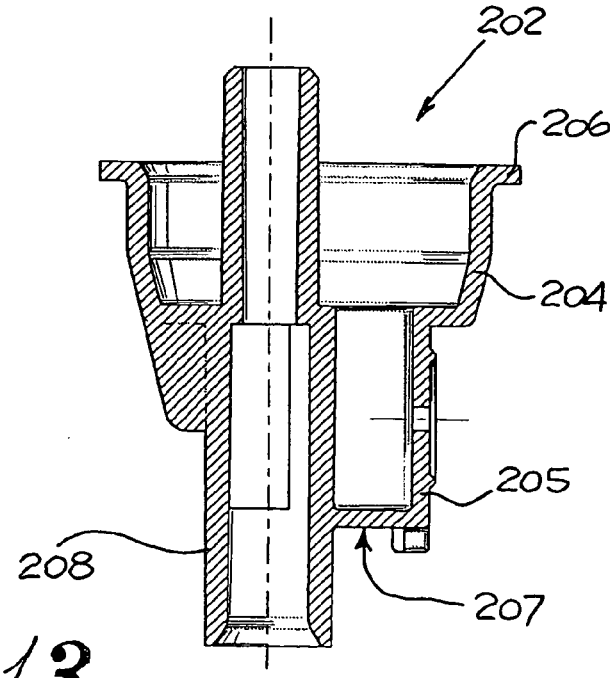
Figure 14:
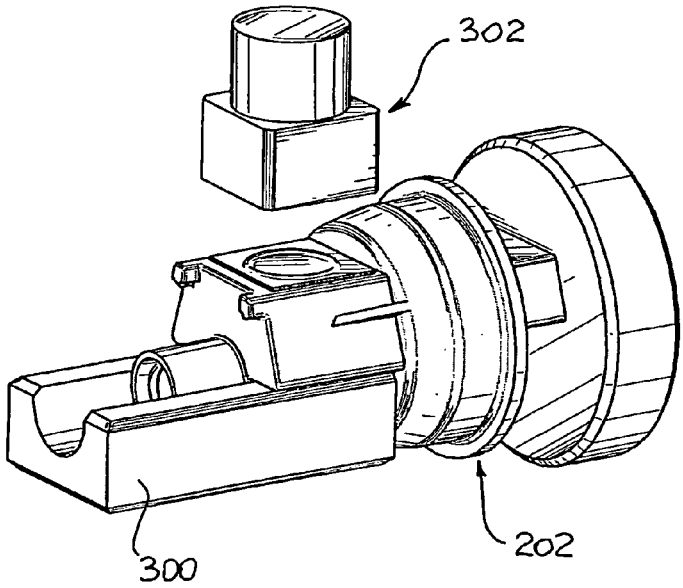
FIG. 14 is a perspective drawing of a flange working with a support and an attachment head.
Figure 15:
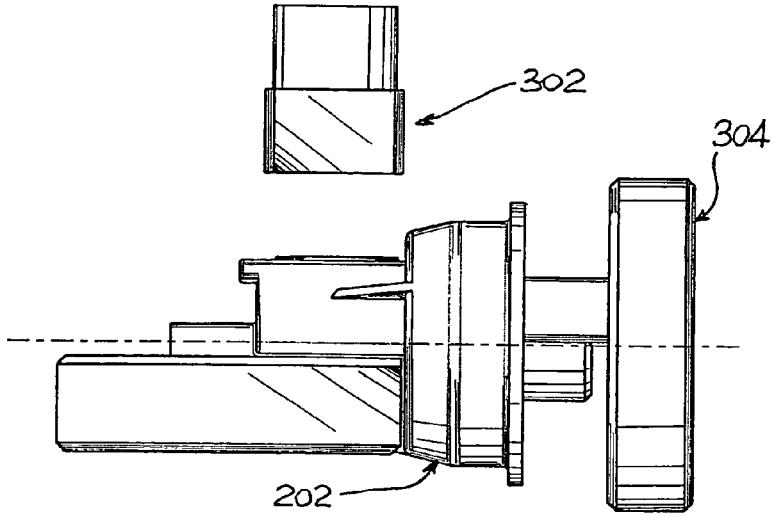
FIG. 15 is a plan view of the flange, the support and the attachment head in FIG. 14, in a step of the application method.
Figure 16:
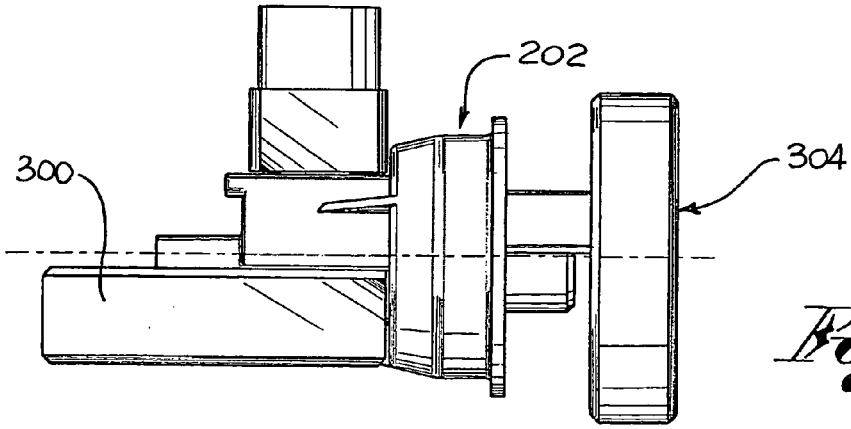
FIG. 16 is a plan view of the flange, support and attachment head of FIG. 14, in a later step of the application method.

In another version produced, the sack 207 is delimited in the posterior section, that is in the part not connected to the filtering means, by the through conduit 208 (FIGS. 12 and 13).

The vent include, moreover, the filtering mechanisms containing a transpiratory membrane 220.

For the attachment of the transpiratory membrane 120, 220 to the vent flange 100, 200, a method can be used to apply the membrane, the method can be carried out by means of attachment apparatus including a support 300, an attachment head 302, a reaction head 304 and means of attachment suitable for bending the transpiratory membrane 120, 220 to attach the membrane to the flange body 102, 202.

The method includes the following steps:

positioning the flange body 102, 202 over the support 300 so that the vent wall 105, 205 is accessible to the attachment head 302;

positioning the transpiratory membrane 120, 220 over the vent wall 105, 205 so that the connecting layer is lying on the vent wall 105, 205;

positioning the reaction head 304 alongside the flange body 102, 202;

using the means of attachment to apply the membrane to the flange body.

Specifically the approach step includes the step of placing the attachment head 302 on the transpiratory membrane 120, 220.

In another version of this method the placement step is preceded by a step during which the reaction head 304 is inserted into the flange body.

Specifically the placement step includes a step of compressing the membrane between the attachment head and the reaction head.

Specifically the step of activating the means of attachment includes a step of welding the transpiratory membrane 120, 220 to the flange body 102, 202 using the attachment head 302.

During normal functioning of the dispensing devices described above the vapors from the liquid contained in the container exhale, transpiring towards the outside environment, and passing through the transpiratory membrane.

At the same time, the liquid contained in the container, upon contact with the transpiratory membrane does not pass to the outside environment, such membrane being permeable only to vapors.

Beneficially, the position of the vent wall compared to the annular wall enables, moreover, the application of a sufficiently extensive membrane to the flange body to guarantee the release of the vapors produced.

In other words the non-radial position of the membrane, which translates into the geometric characteristic of having an orthogonal projection inferior to the membrane itself, makes it possible to apply sufficiently extensive membranes.

At the same time such superficial extension of the vent wall makes it possible to place the attachment head such as a welding head, close to the membrane so as to attach the membrane to the flange body using established and efficient technology.

Another beneficial aspect is that the substantially flat vent wall makes it much easier to apply the membrane.

A further advantage moreover is that the vent flange couples onto the tubular element for the suction of the liquid in such a way as to make it tight, avoiding bathing the transpiratory membrane with liquid from the connecting layer part.

A technician experienced in this area may modify the dispensing devices described above so as to meet contingent requirements and specifications.

In another version for example the pumping mechanism uses a traditional cylinder-piston system.

What is claimed is:

1. A device for dispensing at least one liquid, said device comprising:

a dispenser head including a pumping mechanism for suction and dispensing of at least one liquid;

a liquid container having at least one inner compartment accessible through an opening for the coupling of the container to the dispenser head, such opening being delimited by an annular rim which extends around a geometric axis, and a vent flange disposed between the dispenser head and the liquid container, said vent flange comprising a) an annular wall inserted in the container through the opening, wherein the annular wall comprises at least one vent wall arranged so as to separate, at least partially, the inner compartment from environment external to said compartment, and wherein at least one vent conduit connecting the inner compartment with the environment passes through said annular wall, b) a filter functioning with the vent conduit, allowing the passage of gaseous fluids through the conduit and preventing the passage of the liquid to the environment, wherein the filter occupies a coupling area on the vent wall, and c) a tubular element enabling the liquid to travel from the inner compartment towards the pumping mechanism, the annular wall being positioned in an annular manner externally to the tubular element, wherein the coupling area, comprises a coupling surface which is flat, and the coupling surface and the geometric axis are not perpendicular to one another.

2. A device according to claim 1, further comprising means for connecting the dispenser head to the container, wherein the vent wall is biased by the connecting means toward the annular rim to the container so as to be held to the device, avoiding liquid leakage to the external environment.

3. A device as in claim 1, in which the filter includes a semi-permeable transpiratory membrane.

4. A device as in claim 3, in which the transpiratory membrane has a multi-layered structure.

5. A device as in claim 4, in which the membrane includes a transpiratory layer.

6. A device as in claim 4, in which the membrane includes a connecting layer attaching the transpiratory membrane to the vent wall.

7. A device in claim 1, in which the vent flange includes a ledge wall, connected to the annular wall and suitable for abutting the rim of the opening.

8. A device as in claim 7, in which the vent wall protrudes from the annular wall in the form of a sump.

9. A device as in claim 8, in which the flange body has an asymmetric configuration.

10. A device as in claim 1, in which the vent wall abuts against a welding head to attach the filter to the vent wall.

11. A vent flange which may be used with a dispensing device for dispensing at least one liquid in which the dispensing device comprises:

a dispenser head suitable for accommodating a pump mechanism for the suction and dispensing of at least one liquid; and a container suitable for containing at least one liquid, in which the container has at least one inner compartment accessible through an opening for the coupling of the container to the dispenser head, such opening being delimited by an annular rim which extends around a geometric axis, a projection plane being defined as a plane perpendicular to the geometric axis; wherein the vent flange comprises an annular wall which is suitable for being inserted in the container through the opening in which the annular wall includes at least one vent wall arranged so as to separate, at least partially, the inner compartments from the environment external to the compartment, in which at least one vent conduit suitable for connecting the inner compartment with the environment external to the compartment passes through the wall;

a filter functioning with the vent conduit, suitable for allowing the passage of gaseous fluids through the conduit and preventing the passage of the liquid to the outside in which the filter occupies a coupling area on the vent wall;

a tubular element suitable for enabling the liquid to travel from the inner compartment towards the pumping mechanism, the annular wall being positioned in an annular manner externally to the tubular element;

the vent flange having a coupling area which is not perpendicular to the geometric axis and which projects parallel to the geometric axis on the projection plane and defines a projection with a smaller area than the area of the coupling area.

* * * * *